US008870524B1

(12) United States Patent
Liang

(10) Patent No.: US 8,870,524 B1
(45) Date of Patent: Oct. 28, 2014

(54) INDUSTRIAL TURBINE STATOR VANE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 688 days.

(21) Appl. No.: 13/113,039

(22) Filed: May 21, 2011

(51) Int. Cl.
*F01D 9/02* (2006.01)
*F01D 9/06* (2006.01)

(52) U.S. Cl.
CPC .. *F01D 9/065* (2013.01); *F01D 9/02* (2013.01)
USPC ..... 415/115; 415/116

(58) Field of Classification Search
USPC ..... 164/365, 369, 397; 415/115, 116; 416/90 R, 96 R, 97 R
See application file for complete search history.

(56) References Cited

U.S. PATENT DOCUMENTS 5,827,043 A * 10/1998 Fukuda et al. ..... 415/115
6,340,047 B1 * 1/2002 Frey ..... 164/137
6,915,840 B2 * 7/2005 Devine et al. ..... 164/516
6,929,825 B2 * 8/2005 Wustman et al. ..... 427/250
6,966,756 B2 * 11/2005 McGrath et al. ..... 416/97 R
7,270,170 B2 * 9/2007 Beals et al. ..... 164/132
7,610,946 B2 * 11/2009 Morris et al. ..... 164/516
7,674,093 B2 * 3/2010 Lee et al. ..... 416/97 R
7,704,048 B2 * 4/2010 Liang ..... 416/97 R
8,105,031 B2 * 1/2012 Trindade et al. ..... 416/97 R
8,454,301 B1 * 6/2013 Liang ..... 415/116
8,628,294 B1 * 1/2014 Liang ..... 415/115
2008/0145234 A1 * 6/2008 Lee et al. ..... 416/96 R
2009/0068023 A1 * 3/2009 Liang ..... 416/97 R

* cited by examiner

*Primary Examiner* — Edward Look
*Assistant Examiner* — Christopher R Legendre
(74) *Attorney, Agent, or Firm* — John Ryznic

(57) ABSTRACT

An industrial engine turbine stator vane with a three-pass aft flowing serpentine cooling circuit and turn channels formed outside of the endwalls that connect adjacent legs of the serpentine flow circuit. A ceramic core used to cast the vane includes dual print-outs extending from the turn channel forming pieces that provide a more rigid core structure to prevent core shift or movement during casting. The dual core print-outs form purge air holes for the rim cavity that is then covered with cover plates if purge air holes are not required.

2 Claims, 8 Drawing Sheets

INDUSTRIAL TURBINE STATOR VANE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a stator vane in an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The turbine of the engine includes rows of stator vanes and rows of rotor blades with labyrinth seals formed between the stationary vanes and the rotating blades to prevent hot gas from the mainstream flow entering into the rim cavities within the inter-stage housing of the turbine. The turbine rotor disks are limited to lower temperatures than are the airfoils of the vanes and blades in order to provide for long service life. Excessive temperature exposure will result in cracks in rotor disks that can lead to shortened life or in some cases failure of the rotor disk such as exploding into pieces.

Turbine vanes are produced using an investment casting process in which a ceramic core is used to form the internal cooling air passages of the airfoil. The ceramic core must be retained in position within a mold during the liquid molten metal pouring operation in forming the vane. Core shift or core breakage results in low casting yields which directly result in high cost of the parts.

BRIEF SUMMARY OF THE INVENTION

A turbine stator vane with a serpentine flow cooling circuit to provide cooling for the airfoil, with inner diameter turn and outer diameter turn channels to form a smooth cooling air path between adjacent legs of the serpentine flow circuit, where the turn channels are formed outside of the endwalls so as not to be directly exposed to the external hot gas stream and where core print-outs can be used to support the ceramic core for the casting process. A ceramic core used to cast the vane includes dual ceramic core supports or print-outs for the two turn channels to add rigidity to the ceramic core during the casting process. The holes left over from the print-outs are covered with a cover plate and purge air holes can be formed so that bleed air from the serpentine flow cooling air is used as purge air for the rim cavity located below the inner diameter endwall.

DETAILED DESCRIPTION OF THE INVENTION

Figure 1:
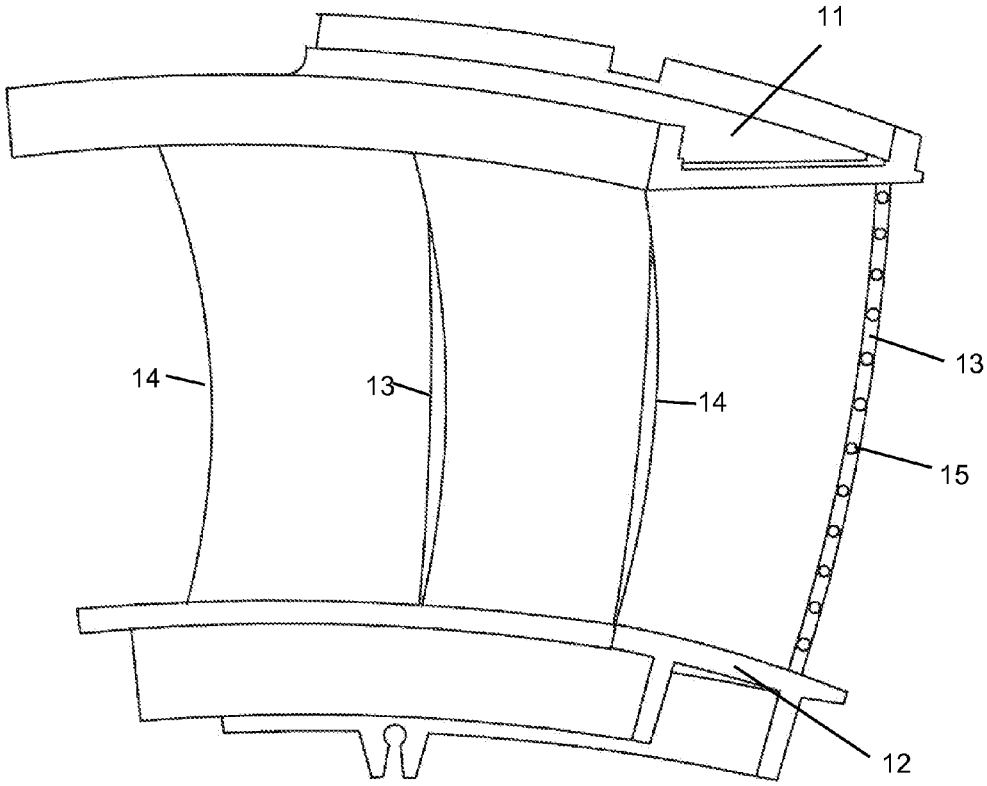
FIG. 1 shows a schematic view of a stator vane segment in which the cooling circuit of the present invention can be used.
Figure 2:
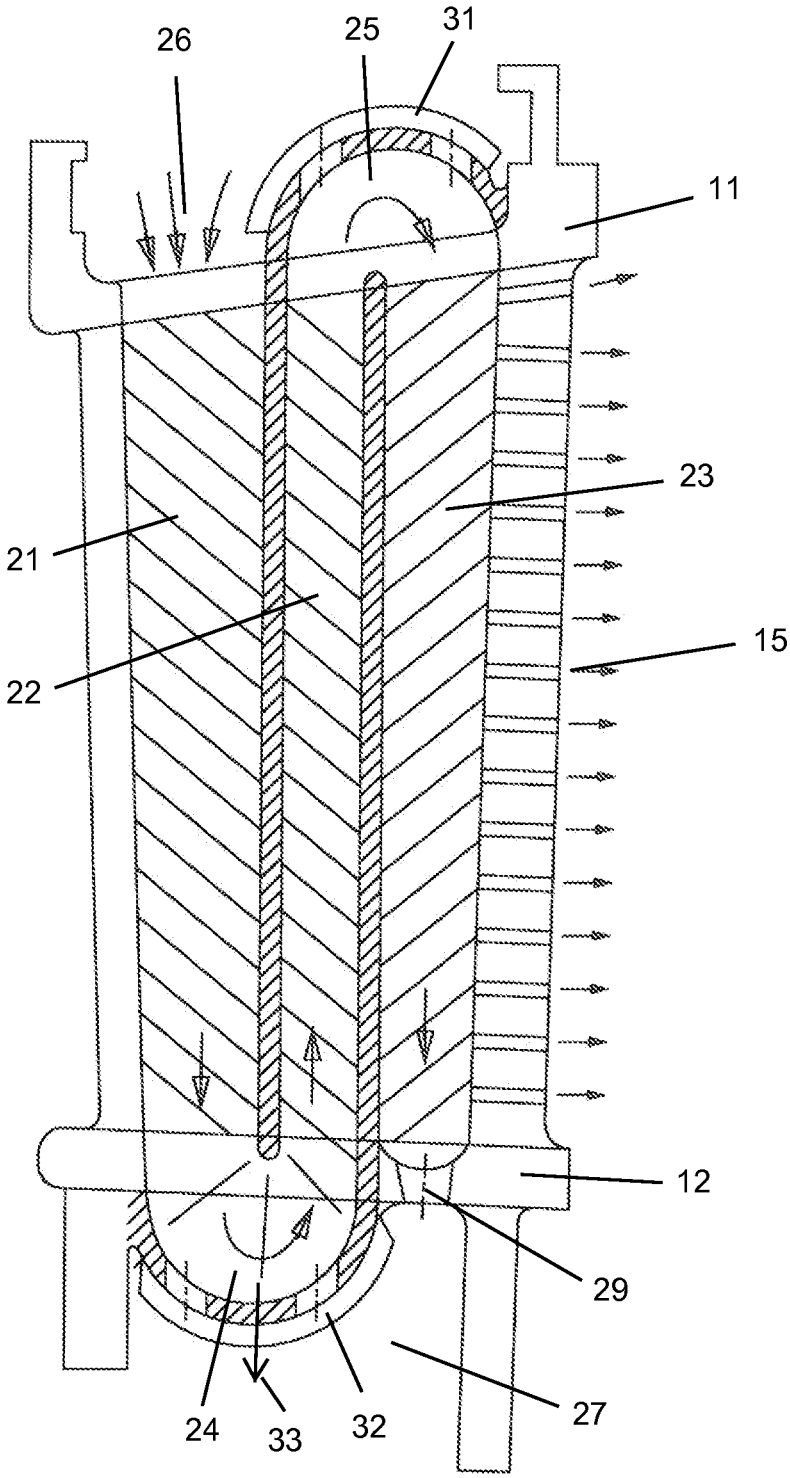
FIG. 2 shows a cross section side view of the cooling circuit for the vane of the present invention.

A turbine stator vane with an aft flowing serpentine flow cooling circuit for a large industrial gas turbine engine with an improved serpentine flow turn channel support for a ceramic core that is used to cast the vane, especially for a vane segment that includes multiple airfoils extending between the outer and inner diameter endwalls. FIG. 1 shows a stator vane segment with three airfoils extending between an outer endwall 11 and an inner endwall 12. Each airfoil includes a leading edge 14 and a trailing edge 13, where a row of exit holes 15 open onto the trailing edge 13. FIG. 2 shows a cross section side view of the vane with the cooling circuit of the present invention. The vane includes a triple pass aft flowing serpentine flow cooling circuit with a first leg 21 located along the leading edge, a second leg 22 located aft of the first leg 21, and a third leg 23 located adjacent to the trailing edge region of the airfoil. An inner diameter endwall turn channel 24 connects the first leg 21 to the second leg 22, and an outer diameter endwall turn channel 25 connects the second leg 22 to the third leg 23. The two turn channels are located outside of the endwalls so that the turn channels are not directly exposed to the hot gas stream passing across the airfoil and the hot endwall surfaces. A row of exit holes 15 are located along the trailing edge and are connected to the third leg 23 to discharge cooling air from the airfoil. The third leg 23 has a decreasing cross sectional flow area in order to maintain a high flow rate in the cooling air as the cooling air is gradually discharged through the exit holes 15. Cooling air from above the outer endwall 26 is supplied to the first leg 21 of the serpentine flow cooling circuit.

Figure 3:
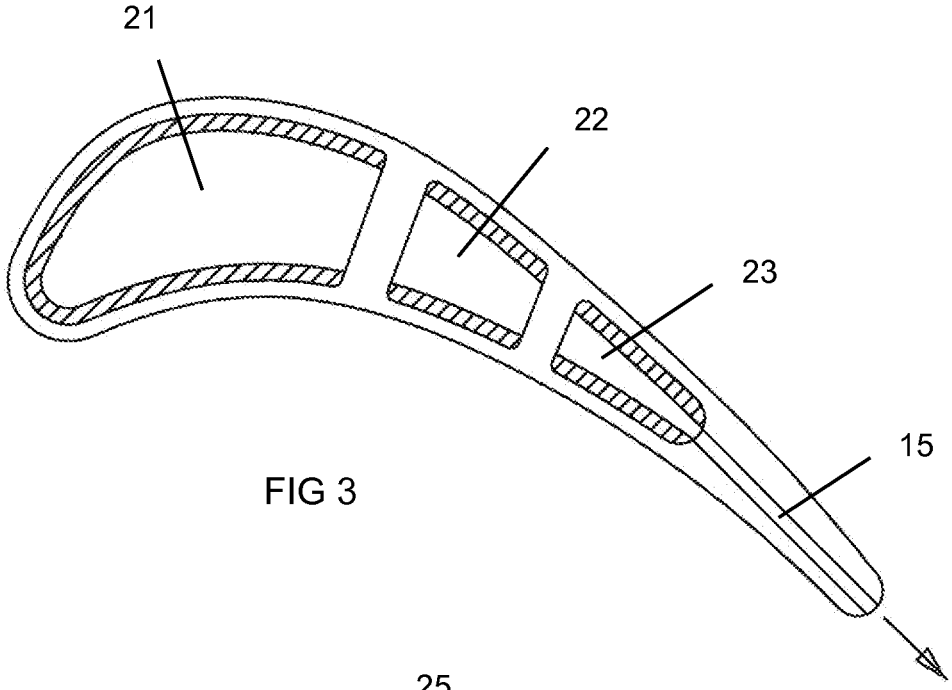
FIG. 3 shows a cross section top view of the cooling circuit for the vane of the present invention.
Figure 4:
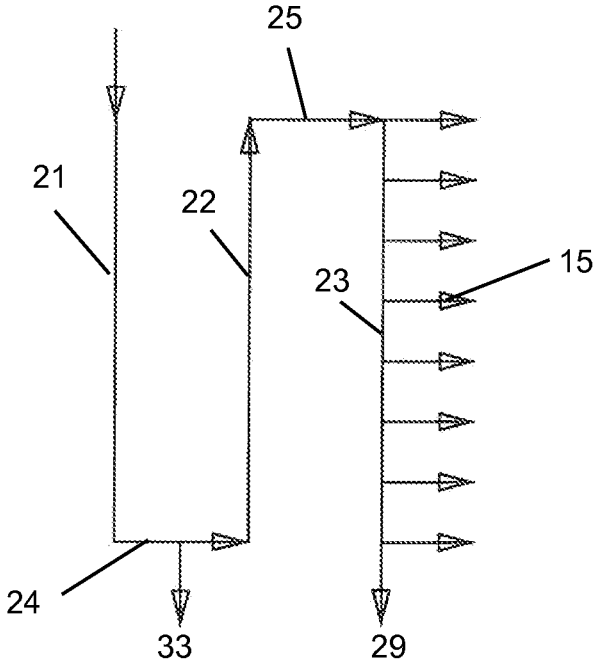
FIG. 4 shows a flow diagram for the cooling circuit for the vane of the present invention.
Figure 5:
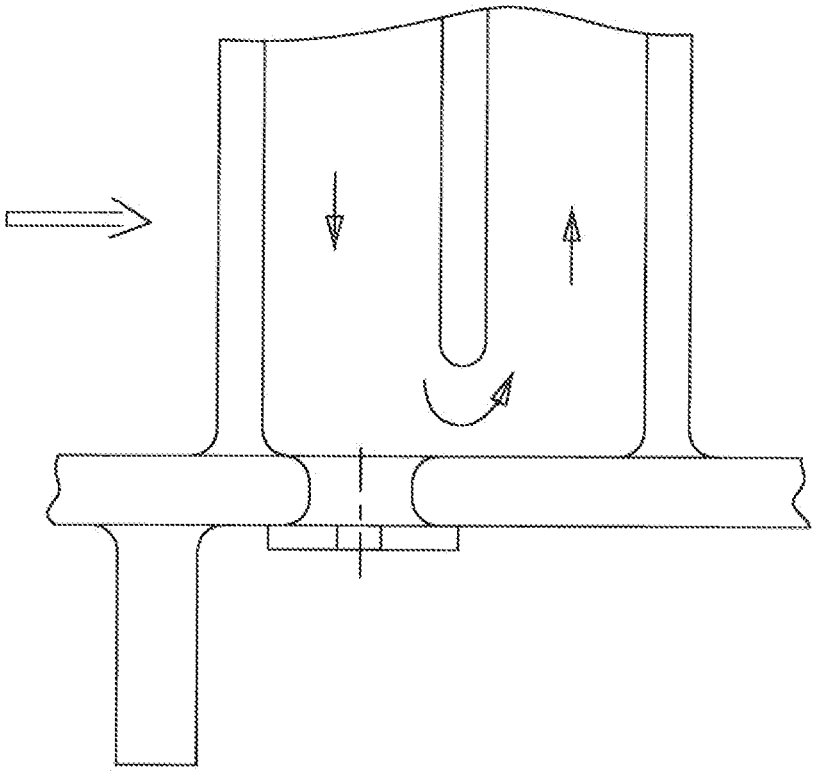
FIG 5 Prior Art
FIG. 5 shows a cross section side view of a lower turn channel with a purge hole for a vane of the prior art.
Figure 6:
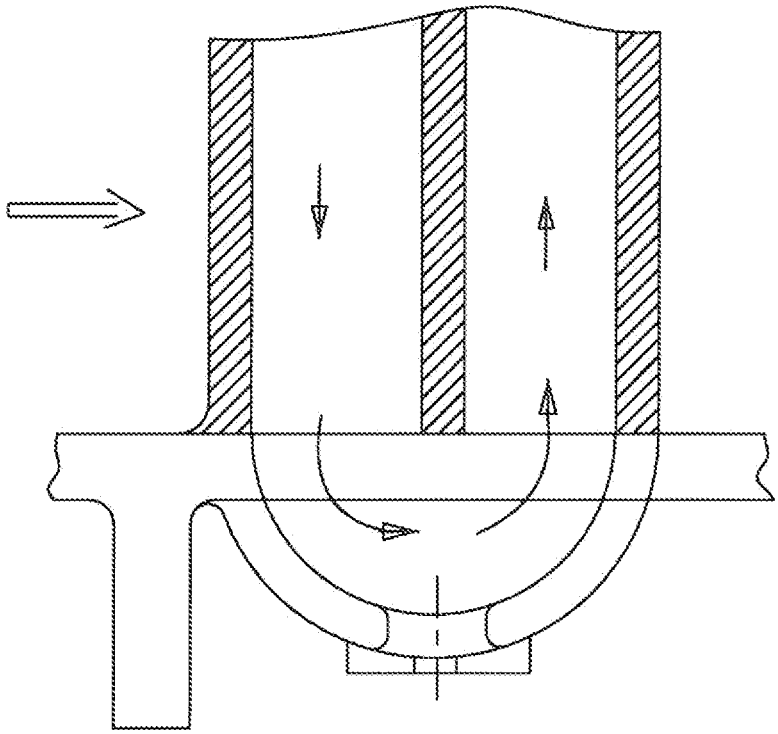
FIG 6 Prior Art
FIG. 6 shows a cross section side view of a lower turn channel with a turn channel located below the inner diameter endwall with a single print-out hole that forms a metering hole for purge air of a rim cavity for a vane of the prior art.

FIG. 3 shows a cross section top view of the vane cooling circuit of FIG. 2 with the three legs 21-23 connected in series and the exit holes 15 along the trailing edge connected to the third leg 23. FIG. 4 shows a flow diagram for the cooling circuit of the vane in FIG. 2. One or more purge air holes 33 are formed in the inner endwall turn channel and one purge air hole 29 in the end of the third leg 23 formed from the core print-outs are used to supply purge air to the rim cavities.

Figure 7:
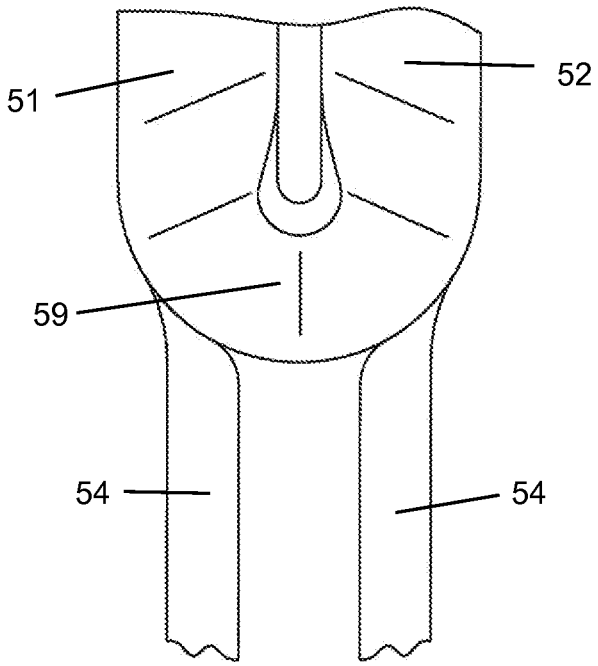
FIG. 7 shows a cross section side view for a lower section of a ceramic core used to cast the vane with the ceramic core support of the present invention.
Figure 9:
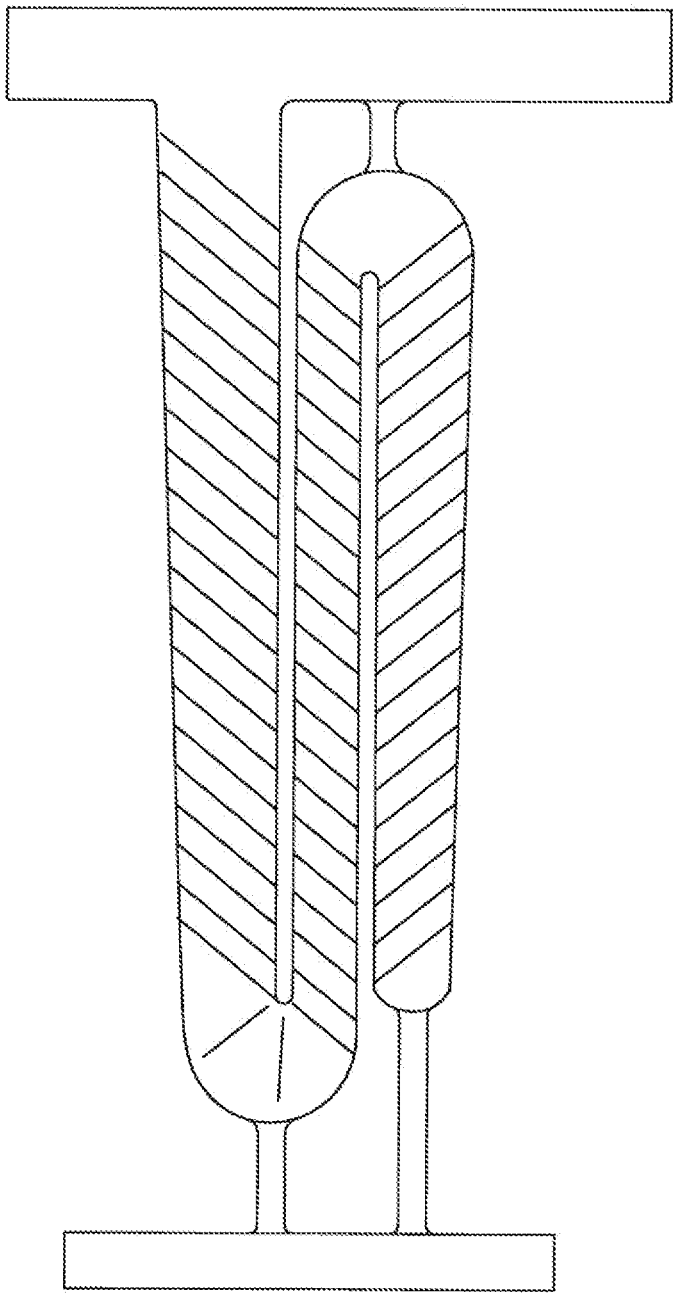
FIG 9 Prior Art
FIG. 9 shows a prior art ceramic core used to cast a vane of the prior art having the inner diameter turn channel of FIG. 6.

In order to cast the vane with a higher yield, an improvement in the ceramic core support is required, especially for industrial turbine vanes that have relatively long airfoils. FIG. 7 shows a lower end of the ceramic core used to cast the vane of the present invention in which the inner diameter turn channel is supported by not one but two core print-outs 54. The ceramic core includes a first leg forming section 51 and a second leg forming section 52 with a turn channel forming section 59, and with two core print-outs 54 extending from below the first leg forming section 51 and the second leg forming section 52. Using two core print-outs 54 instead of a single core print-out as shown in FIG. 9 significantly reduces core shift during casting in a sideways motion and a twisting motion, especially for long ceramic cores that are used to form large industrial engine vanes.

Figure 8:
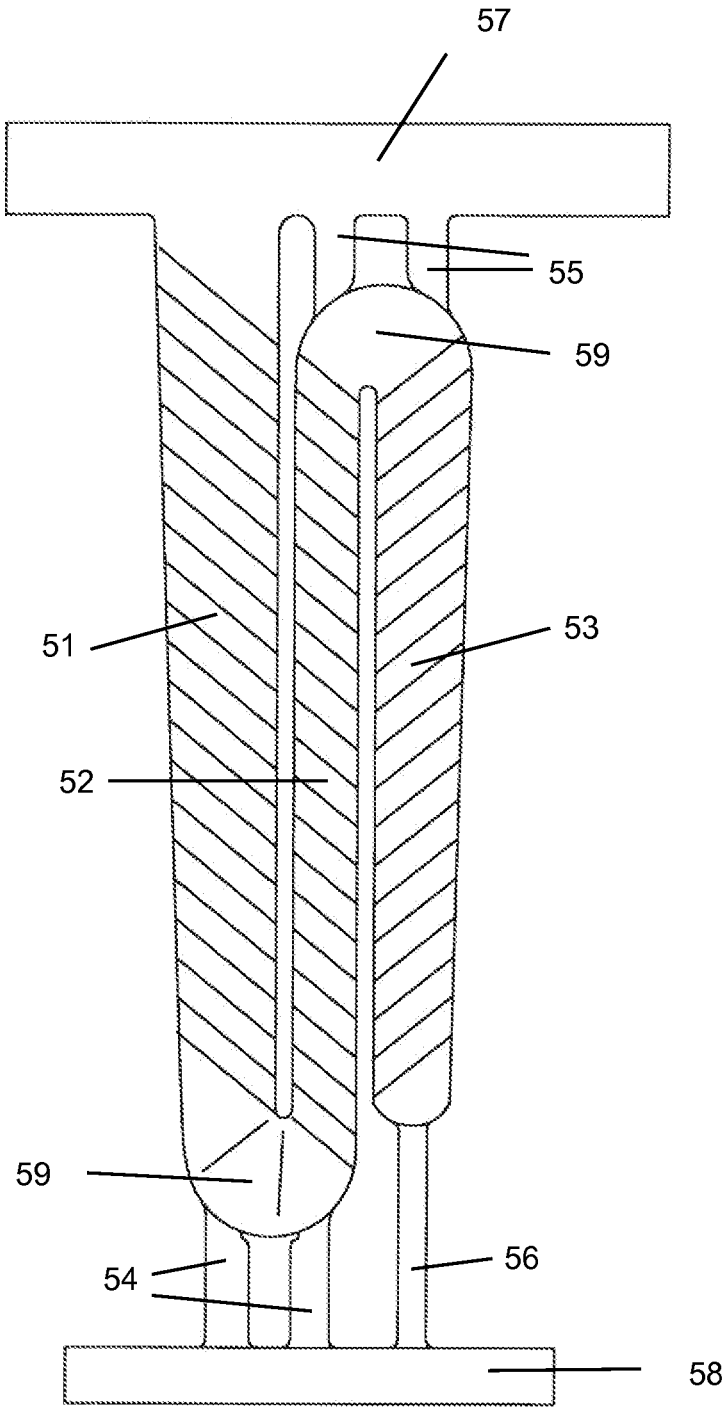
FIG. 8 shows a cross section side view of a ceramic core of the present invention used to cast the vane of the present invention.

FIG. 8 shows a complete ceramic core used to form the internal cooling air passages within the vane of the present invention. Outer main support 57 and inner main support 58 provide support for the three pieces 51-53 that form the three legs of the serpentine flow circuit. The third leg piece 53 is supported by a core print-out piece 56 that is secured by the low main support piece 58 and later becomes the purge air hole formed at an end of the third leg 23. The turn channel forming pieces 59 are each supported by two core print-outs 54 and 55 that extend from the turn channel forming piece 59 to the respective main support piece 57 or 58. Use of two core print-outs 54 and 55 to support the serpentine flow circuit forming pieces 51-53 provides better core support that a single print-out even if the single core print-out is made larger. The print-outs 54 and 55 extend from the leg forming pieces in alignment with the leg forming pieces as seen in FIG. 8. The left print-out 54 is aligned with a center of the first leg forming piece 51 and the right print-out 54 is aligned with the second leg forming piece 52. This same alignment is used for the other two print-outs 55 extending from the second and third leg forming pieces 52 and 53.

When the vane is cast using the ceramic core of FIG. 8, two holes are left in the turn channels from the print-outs when they are leached away. Cover plates 31 and 32 are placed over the turn channels to cover over these resulting holes. A purge hole 33 can be formed in the lower cover plate 32 to discharge purge air from the turn channel 24 for use in purging the rim cavity 27. A purge hole 29 is formed at an end of the third leg 23 by the core print-out 56 and discharges any remaining cooling air flow from the third leg 23 that does not exit the airfoil through the exit holes 15 to purge the rim cavity 27. The lower turn channel purge hole 33 can also be formed in the cover plate 32 where the holes are formed from the two print-outs 54 by drilling through the cover plate 32 and into the resulting holes. One or more of these holes can be formed for purging the rim cavity using bleed off air from the serpentine flow cooling air passing along the inner diameter turn channel 24.

I claim the following:

1. A turbine stator vane for an industrial gas turbine engine, the vane comprising:

an airfoil extending between an outer diameter endwall and an inner diameter endwall;

a three-pass serpentine flow cooling circuit with a first leg located along a leading edge of the airfoil and a third leg located adjacent to a trailing edge of the airfoil;

an inner diameter turn channel located below the inner diameter endwall and connected between the first leg and a second leg of the serpentine flow circuit;

an outer diameter turn channel located above the outer diameter endwall and connected between the second leg and the third leg of the serpentine flow circuit;

a row of exit cooling holes located along a trailing edge of the airfoil and connected to the third leg;

a purge air hole connected to an end of the third leg;

two purge air holes formed in the inner endwall turn channel and covered with an inner diameter turn channel cover plate; and, two purge air holes formed in the outer endwall turn channel and covered with an outer diameter turn channel cover plate.

2. The turbine stator vane of claim 1, and further comprising:

a purge air hole formed in the inner diameter turn channel cover plate and connected to the inner diameter turn channel.

* * * * *